US008443768B2

(12) United States Patent
Berghian et al.

(10) Patent No.: US 8,443,768 B2
(45) Date of Patent: May 21, 2013

(54) HIGH-FLOW CYLINDER LINER COOLING GALLERY

(75) Inventors: Petru M. Berghian, Livonia, MI (US); Dan H. Dinu, Windsor (CA)

(73) Assignee: Mahle International GmbH (DE)

( * ) Notice: Subject to any disclaimer, the term of this patent is extended or adjusted under 35 U.S.C. 154(b) by 585 days.

(21) Appl. No.: 12/697,813

(22) Filed: Feb. 1, 2010

(65) Prior Publication Data

US 2010/0206261 A1 Aug. 19, 2010

Related U.S. Application Data

(60) Provisional application No. 61/153,092, filed on Feb. 17, 2009.

(51) Int. Cl.
*F02F 1/10* (2006.01)

(52) U.S. Cl.
USPC ..... 123/41.84; 123/193.2; 29/888.06; 29/888.061

(58) Field of Classification Search
USPC ..... 123/41.84, 41.72, 193.2; 29/888.06, 29/888.061
See application file for complete search history.

(56) References Cited

U.S. PATENT DOCUMENTS

| | | | | |
|---|---|---|---|---|
| 2,244,323 | A * | 6/1941 | Antonsen et al. | 123/41.78 |
| 2,277,113 | A * | 3/1942 | Kimmel | 123/41.08 |
| 3,086,505 | A * | 4/1963 | Bovard | 123/41.8 |
| 4,640,236 | A | 2/1987 | Nakano et al. | |
| 4,926,801 | A * | 5/1990 | Eisenberg et al. | 123/41.84 |
| 5,086,733 | A * | 2/1992 | Inoue et al. | 123/41.84 |
| 5,199,390 | A * | 4/1993 | Hama et al. | 123/41.84 |
| 5,207,188 | A * | 5/1993 | Hama et al. | 123/41.79 |
| 5,207,189 | A * | 5/1993 | Kawauchi et al. | 123/41.84 |
| 5,233,947 | A * | 8/1993 | Abe et al. | 123/41.79 |
| 5,251,578 | A * | 10/1993 | Kawauchi et al. | 123/41.84 |
| 5,299,538 | A | 4/1994 | Kennedy | |
| 5,386,805 | A * | 2/1995 | Abe et al. | 123/41.28 |
| 5,505,167 | A | 4/1996 | Kennedy | |
| 5,749,331 | A * | 5/1998 | Pettersson et al. | 123/193.2 |
| 5,957,163 | A * | 9/1999 | Ito et al. | 138/109 |
| 5,979,374 | A | 11/1999 | Jackson | |
| 6,123,052 | A | 9/2000 | Jahn | |
| 6,357,400 | B1 * | 3/2002 | Bedwell et al. | 123/41.84 |
| 6,675,750 | B1 | 1/2004 | Wagner | |
| 7,000,584 | B1 * | 2/2006 | Wynveen et al. | 123/193.2 |

(Continued)

FOREIGN PATENT DOCUMENTS

| | | | |
|---|---|---|---|
| GB | 128940 | A | 3/1920 |
| JP | 59185818 | A * | 10/1984 |

OTHER PUBLICATIONS

International Search Report for PCT/EP2010/000867, issued on May 26, 2010.

*Primary Examiner* — Noah Kamen
*Assistant Examiner* — Hung Q Nguyen
(74) *Attorney, Agent, or Firm* — Rader, Fishman & Grauer PLLC

(57) ABSTRACT

A cylinder liner for an internal combustion engine and a method of making the same are disclosed. The cylinder liner may generally include a cylindrical body configured to receive a piston assembly. The cylindrical body may further include a main body portion configured for selective engagement with an engine bore, and an upper flange configured to support the cylindrical body within the engine bore. The cylindrical body may also define an undulating cooling gallery adjacent the upper flange. The undulating cooling gallery generally defines a single coolant flow path extending about a perimeter of the cylindrical body.

24 Claims, 7 Drawing Sheets

U.S. PATENT DOCUMENTS 7,131,417 B1 11/2006 Jones et al.
7,334,546 B2 2/2008 Rasmussen
7,337,756 B1 3/2008 Ruble et al.
2006/0249105 A1 11/2006 Azevedo

* cited by examiner

HIGH-FLOW CYLINDER LINER COOLING GALLERY

RELATED APPLICATIONS

The present application claims priority to U.S. Provisional Application Ser. No. 61/153,092, filed Feb. 17, 2009, the contents of which are incorporated herein in their entirety.

BACKGROUND

Power cylinders of internal combustion engines generate intense heat from the combustion cycle. As a result, it is necessary to circulate coolant throughout the engine to reduce operating temperatures. Heat may be especially intense in areas of the engine near the combustion chamber.

Generally, any effort to increase engine cooling by increasing the size of cooling passages comes with a corresponding decrease in engine durability. Engines may be less durable when additional or larger passages are carved out of engine components, e.g., the engine block or cylinder liner areas, in order to achieve greater coolant capacity. Known cooling gallery structures extend generally straight about the perimeter of the power cylinder, e.g., around the perimeter of a cylinder liner and/or engine bore. Adding additional cooling passages or increasing the size of existing cooling passages necessarily results in thinning the walls of the cylinder liner or other engine structures adjacent the combustion chamber. Thinner liner walls, as an example, necessarily reduce the stiffness of the liner, and therefore also reduce the ability of the cylinder liner to resist warping during engine operation.

Accordingly, there is a need in the art for an engine and cylinder liner that offers increased cooling, especially near the engine combustion chamber, while also providing adequate durability.

BRIEF DESCRIPTION OF THE DRAWINGS

While the claims are not limited to the illustrated examples, an appreciation of various aspects is best gained through a discussion of various examples thereof. Referring now to the drawings, illustrative embodiments are shown in detail. Although the drawings represent the embodiments, the drawings are not necessarily to scale and certain features may be exaggerated to better illustrate and explain an innovative aspect of an embodiment. Further, the embodiments described herein are not intended to be exhaustive or otherwise limiting or restricting to the precise form and configuration shown in the drawings and disclosed in the following detailed description. Exemplary embodiments of the present invention are described in detail by referring to the drawings as follows:

DETAILED DESCRIPTION

Reference in the specification to "an exemplary illustration", an "example" or similar language means that a particular feature, structure, or characteristic described in connection with the exemplary approach is included in at least one illustration. The appearances of the phrase "in an illustration" or similar type language in various places in the specification are not necessarily all referring to the same illustration or example.

Various exemplary illustrations are provided herein for a cylinder liner for an internal combustion engine and a method of making the same. The cylinder liner generally includes a cylindrical body configured to receive a piston assembly. The cylindrical body may further include a main body portion configured to be received within an engine bore, and an upper flange configured to support the cylindrical body within the engine bore. The cylindrical body may also define an undulating cooling gallery adjacent the upper flange. The undulating cooling gallery may generally define a single coolant flow path extending about a perimeter of the cylindrical body.

A method of making a cylinder liner may generally include providing a cylindrical body having an upper flange, and forming at least two rows of cuts or cutouts about a periphery of the cylindrical body that is adjacent the upper flange. The cutouts in each of the first and second rows may be generally uniform, e.g., the cutouts may each define a generally same radial depth and a generally same peripheral extent with respect to the cylindrical body. Further, the first and second rows may cooperate to form a generally undulating cooling gallery defining a single flow path about the periphery of the cylindrical body when the cylindrical body is received within a mating engine bore.

Figure 1A:
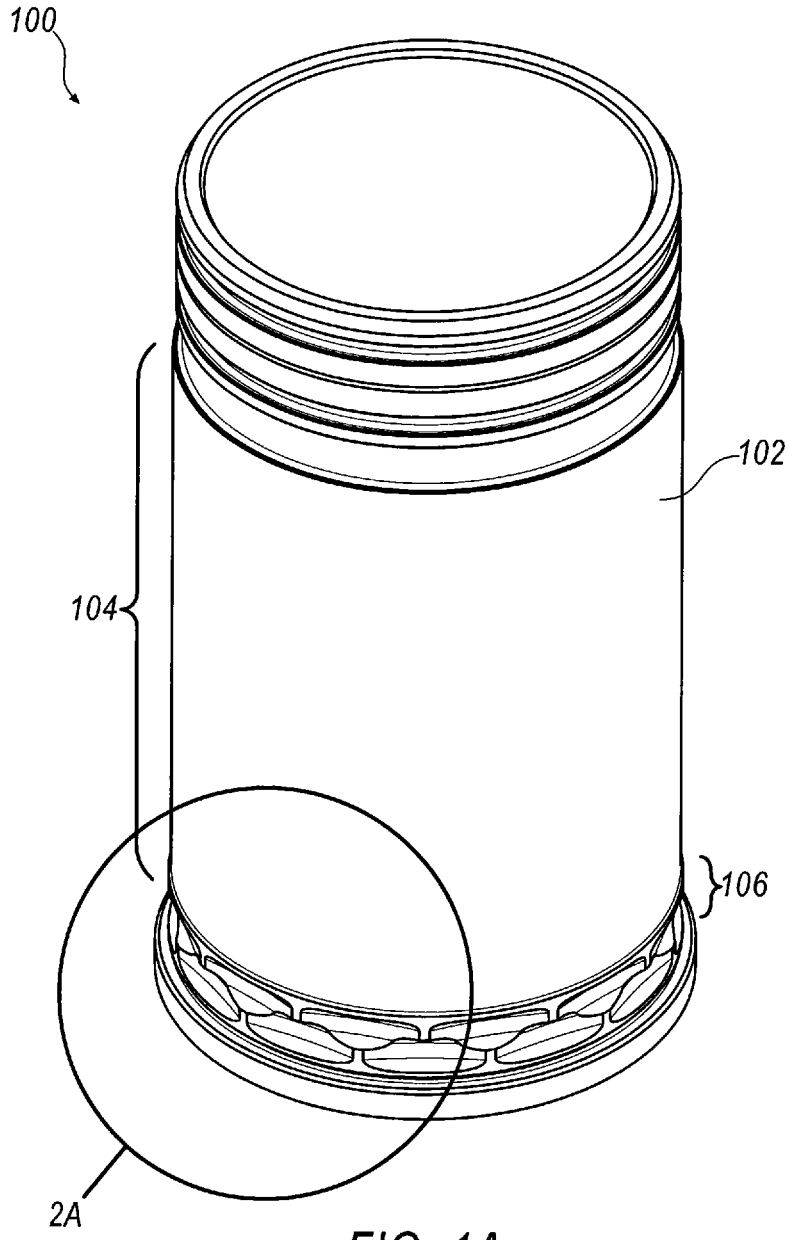
FIG. 1A is a perspective view of an exemplary cylinder liner in an inverted position.
Figure 1B:
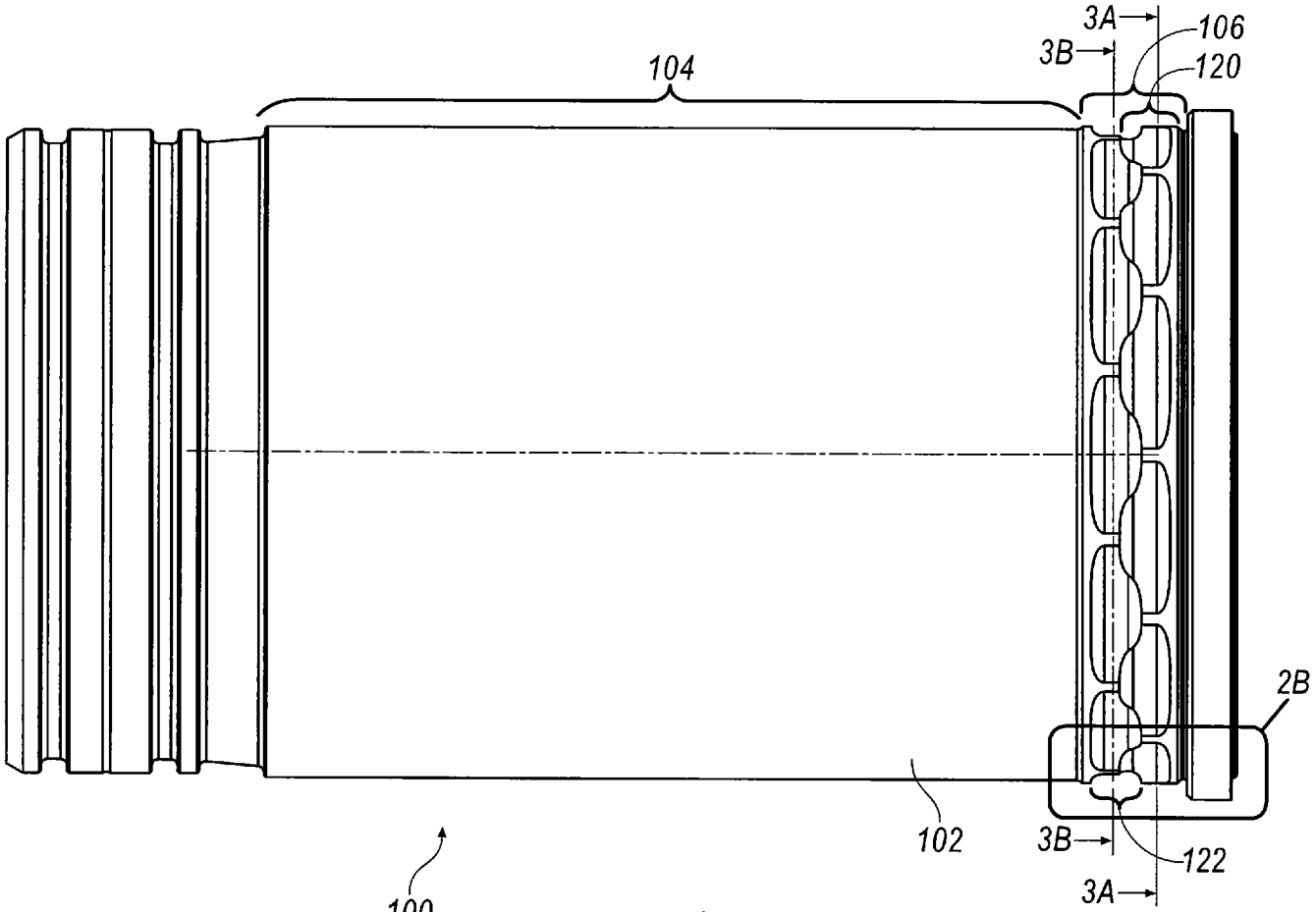
FIG. 1B is a side view of the cylinder liner of FIG. 1A.
Figure 1C:
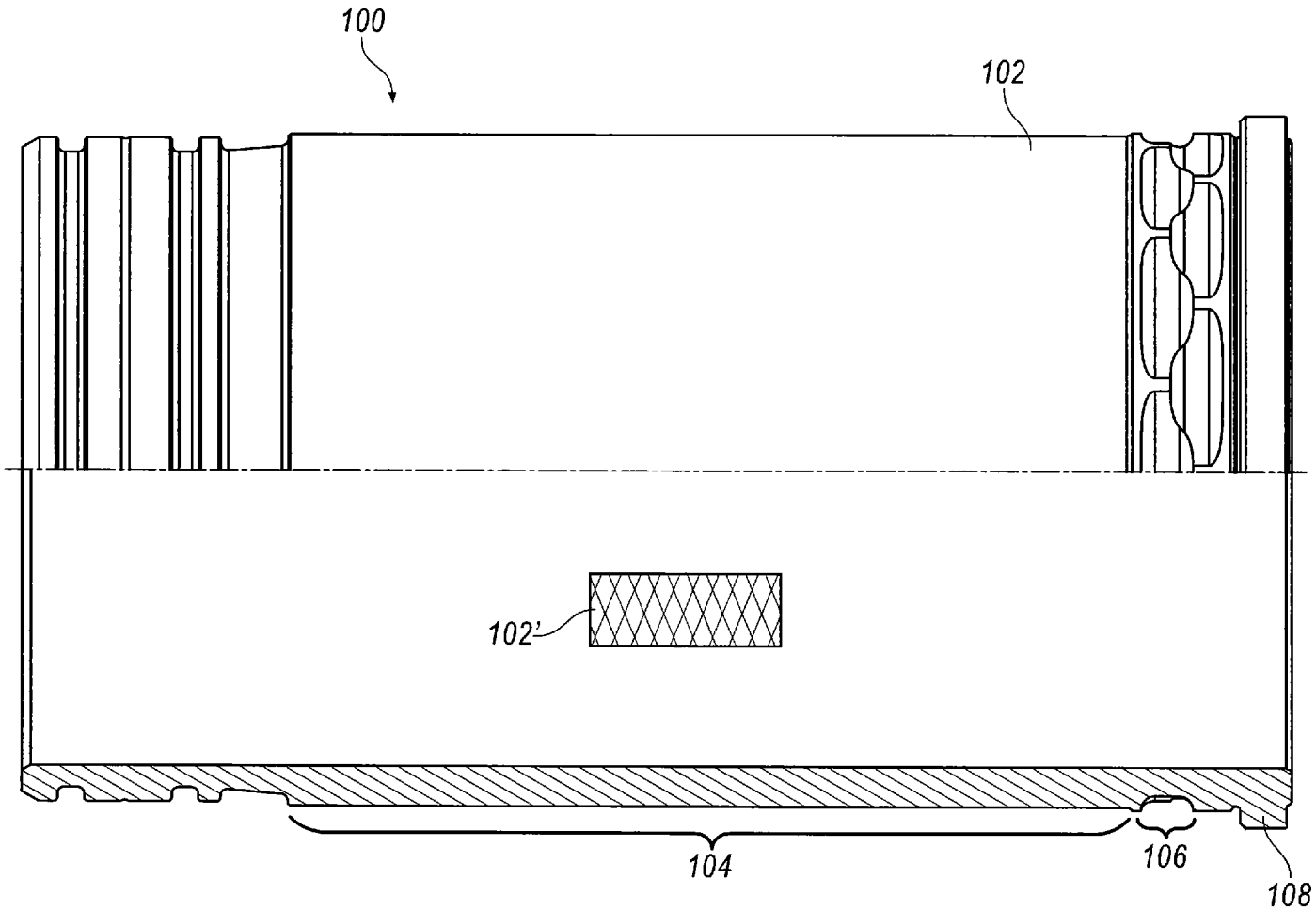
FIG. 1C is a partially sectioned side view of the cylinder liner of FIG. 1A.
Figure 1D:
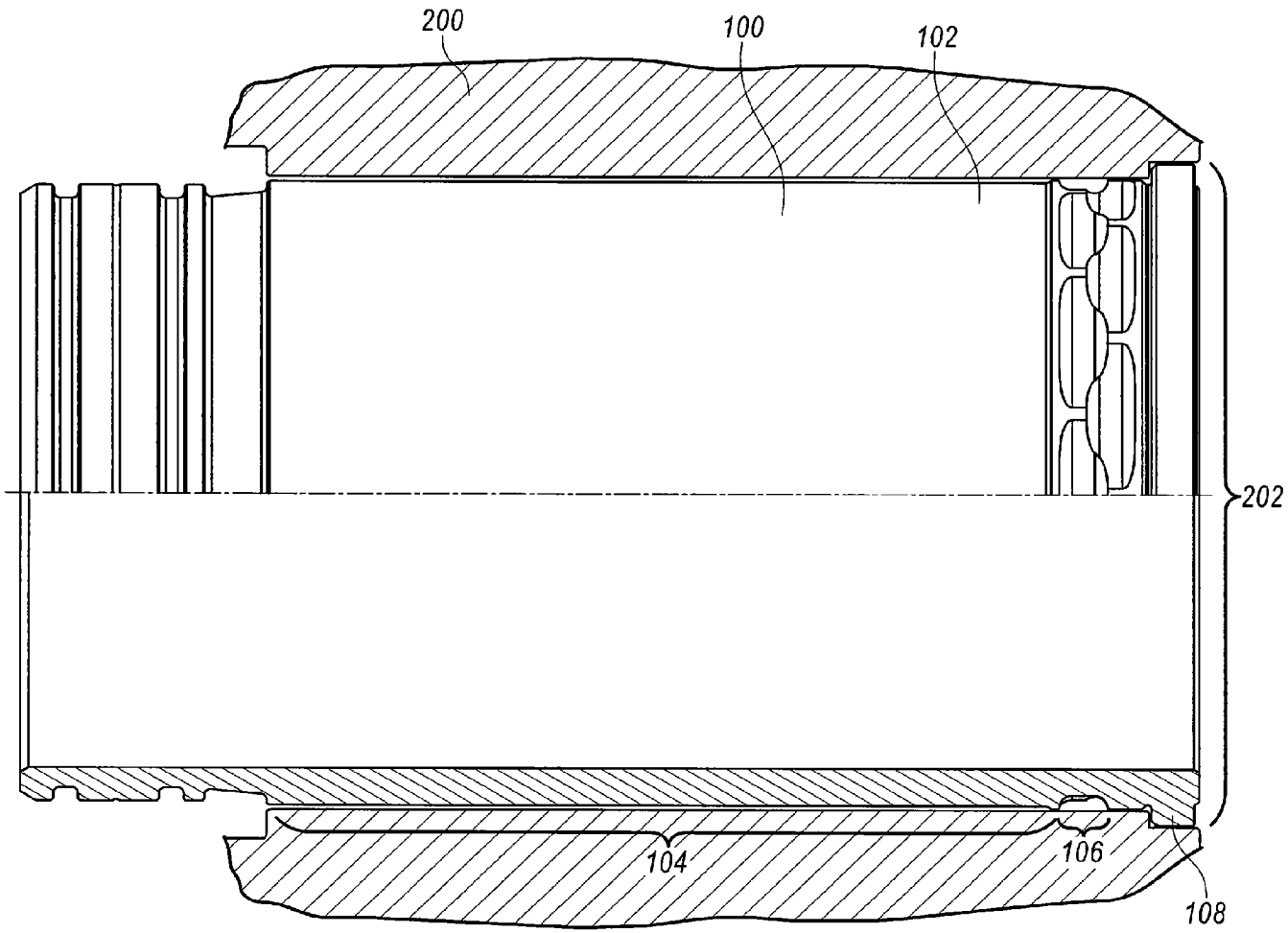
FIG. 1D is the partially sectioned view of FIG. 1C with a section view of an engine block having a bore receiving the cylinder liner.

Turning now to FIGS. 1A, 1B, 1C, and 1D, a cylinder liner 100 is shown that has a main or primary cooling gallery 104 formed in a central portion or main body 102 of the cylinder liner 100. During operation of an engine block 200 receiving the cylinder liner 100, coolant may be circulated about the cylinder liner 100 in the primary cooling gallery 104. The cylinder liner 100 also includes a secondary cooling gallery 106 about an upper or uppermost portion of the cylinder liner 100, e.g., adjacent an upper flange 108 of the cylinder liner 100. The upper flange 108 may generally support the cylinder liner 100 when it sits within an engine bore 202 defined by an engine block 200, as best seen in FIG. 1D.

As best seen in FIG. 1A, which is an isometric view of the cylinder liner 100 in an inverted position (i.e., "upside-down" relative to the positioning of the cylinder liner 100 during use in an engine block), the secondary cooling gallery 106 generally extends about the periphery of the cylinder liner 100 in an undulating or waveform configuration. As with the primary cooling gallery 104, during operation coolant may be circulated through the secondary cooling gallery 106 about the perimeter of the cylinder liner 100. Accordingly, while coolant flowing through the main cooling gallery 104 and the secondary cooling gallery 106 may be drawn from a common source within the engine, the secondary cooling gallery 106 may generally provide a separate flow path for the coolant from the primary cooling gallery 104, at least about portions of the circumference of the cylinder liner 100. The secondary cooling gallery 106 generally cools an upper part of the cylinder liner and/or the cylinder block in the vicinity of a combustion chamber associated with the cylinder liner 100, and where heat transfer occurs most substantially thru piston rings of a piston assembly (not shown) moving within the cylinder liner 100.

The undulating configuration of the secondary cooling gallery may substantially increase contact surface between coolant in the secondary cooling gallery 106 and the cylinder liner 100, as compared with a straight cooling gallery that does not undulate about the periphery of the cylinder liner 100. Contact between the coolant and a cylinder block 200 is thereby also increased, enhancing cooling of the cylinder liner 100 and block 200. The secondary cooling gallery 106 may undulate axially and/or radially with respect to the cylinder liner 100, as will be described further below. Accordingly, an overall distance or extent of the secondary cooling gallery 106 about the periphery of the cylinder liner may be greater than a circumference of the cylinder liner 100 due to the axial and/or radial variation in the coolant path through the secondary cooling gallery 106. At the same time, the undulating configuration of the secondary cooling gallery 106 also allows the cylinder liner 100 to maintain adequate integrity or stiffness despite the increased coolant and/or heat transfer capacity of the cylinder liner 100, as will be described further below.

Figure 2A:
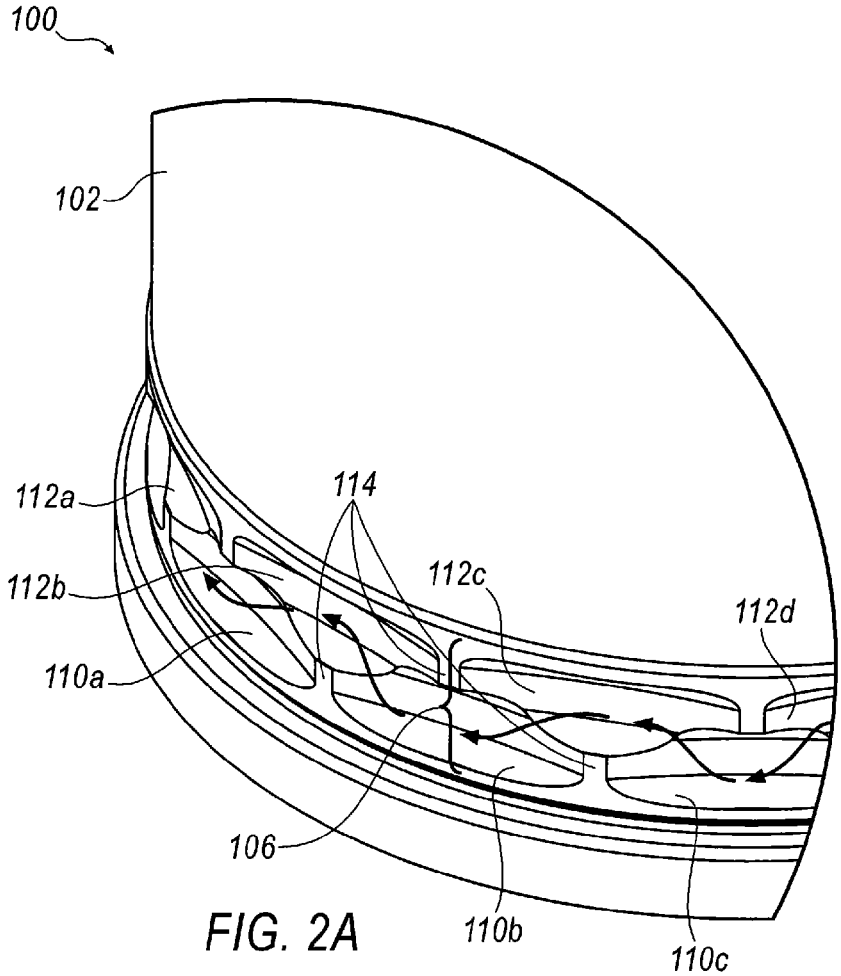
FIG. 2A is a close-up perspective view of the cooling gallery of the cylinder liner as shown in FIG. 1A.
Figure 2B:
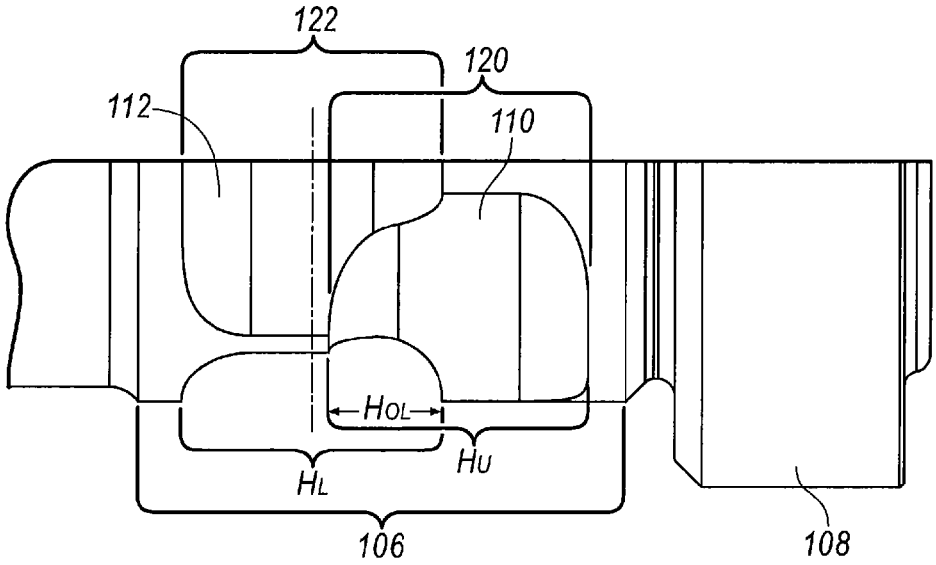
FIG. 2B is a close-up side view of the cooling gallery area of the cylinder liner of FIG. 1B.

Turning now to FIGS. 2A and 2B, the secondary cooling gallery 106 is shown in further detail. The secondary cooling gallery 106 may generally formed by a circumferential series of cavities or cutouts 110, 112 about the perimeter of the cylinder liner 100 or engine block 200, generally around the top of the liner 100 or cylinder block 200 adjacent the flange 108. For example, as best seen in FIG. 2A, which is a close-up view of the secondary cooling gallery 106 in the inverted position as in FIG. 1A, two or more independent rows 120, 122 of cutouts may be provided in the outer peripheral surface of the cylinder liner 100, including an upper row 120 of upper cutouts 110 and a lower row 122 of cutouts 112.

As shown, a coolant flow path (indicated by arrows in FIG. 2A) in the secondary cooling gallery 106 extends about the perimeter of the cylinder liner 100 in a generally single direction. Accordingly, when the cylinder liner 100 is mated to an engine block 200 and received within a cylinder bore 202, e.g., as shown in FIG. 1D, the surfaces of the cylinder liner 100 and engine bore 202 cooperate to generally define the secondary cooling gallery 106 and provide a generally closed path for the coolant extending around the upper or uppermost portion of the cylinder liner 100 adjacent the combustion chamber.

As best seen in FIG. 2B, the lower row 122 of cutouts 112 in the cylinder liner 100 overlaps with the upper row 120 in an axial direction (i.e., in a direction generally parallel to the axis of the cylinder liner 100). For example, the cutouts 110 in the upper row 120 each define an axial height $H_U$ while the cutouts 112 in the lower row 122 define an axial height $H_L$. The heights may be the same or different depending on the application and level of cooling required. The rows 120, 122 of cutouts 110, 112 overlap each other axially by a distance $H_{OL}$. As best seen in FIG. 2A, the cutouts 110 in the upper row 120 are also offset circumferentially with respect to the adjacent cutouts 112 in the lower row 122. For example, upper cutout 110*b* is offset circumferentially from the adjacent cutouts 112*b* and 112*c*.

The combination of axial overlap and circumferential offset between the cutouts 110, 112 in the rows 120, 122 forms a generally undulating shape of the secondary cooling gallery 106 in the surfaces of the cylinder liner 100. A coolant flow path therefore also generally undulates about the circumference of the cylinder liner 100. Coolant flowing through the secondary cooling gallery 106 generally traverses axially up and down with respect to the cylinder liner 100 as it flows about the perimeter of the cylinder liner 100. The resulting gallery is therefore larger with respect to cooling galleries that have a generally straight configuration, at least because the secondary cooling gallery 106 traverses axially up and down about the perimeter of the cylinder liner 100. Accordingly, coolant passing through the secondary cooling gallery must travel a greater distance about the perimeter of the cylinder liner 100 as compared with a cooling gallery where coolant flows directly about the perimeter of the cylinder liner without any axial undulation.

Figure 3A:
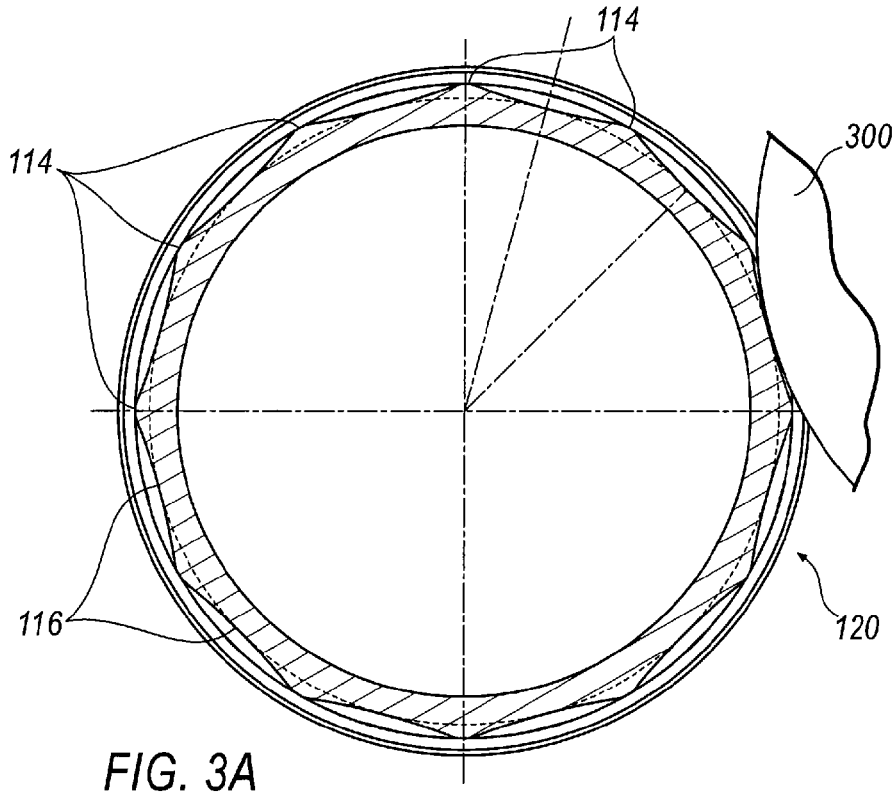
FIG. 3A is a section view of an upper portion of the cooling gallery of the cylinder liner of FIG. 1B, including an exemplary tool for forming the cutouts in the cylinder liner.
Figure 3B:
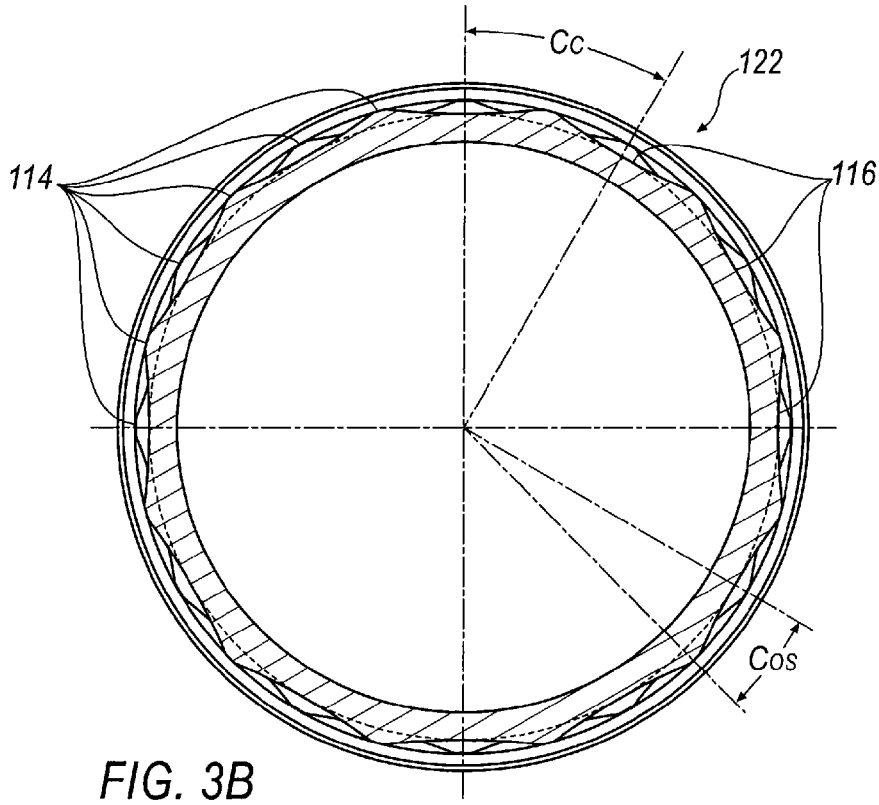
FIG. 3B is a section view of a lower portion of the cooling gallery of the cylinder liner of FIG. 1B.

As best seen in FIGS. 3A and 3B, a single cutting or grinding tool 300 may be used to form the cutouts 110, 112 in the upper and lower rows of the secondary cooling gallery 106. For example, a grinding tool may have a generally disc-shaped configuration, as shown in FIG. 3A, such that the tool 300 may be used to form a semi-circular surface 116 in the cylinder liner 100. In the examples shown in FIGS. 3A and 3B, the tool 300 forms a series of twelve (12) cuts in one exemplary approach about the perimeter of the cylinder liner 100 in each of the upper and lower rows of cutouts 110, 112. The circular surface of the tool 300 leaves a corresponding semi-circular (in section view, as shown in FIGS. 3A and 3B) cut surface 116 that cooperates with the cylinder bore of the engine (not shown in FIGS. 3A, 3B) to form the secondary cooling gallery 106 when the cylinder liner 100 is placed within the engine bore 202. The tool 300 may therefore have a radius corresponding to that of the cut surface 116. Alternatively, a generally straight cutting tool (not shown) may be employed which forms a generally straight or linear cut surface (not shown), e.g., that forms a chord with respect to the generally circular shape of the cylinder liner when viewed in section. Thus, the depth from an outer periphery into the interior of the cylinder line 100 (e.g., a change in the radius represented by tool 300) may be customized depending on the particular level of cooling required.

As best seen in FIGS. 2A, 3A, and 3B, the process of providing uniformly spaced and/or sized cutouts 110, 112 to form the secondary cooling gallery 106 results in a series of circumferentially spaced ribs 114 which remain to increase the stiffness of the cylinder liner 100. As best seen in FIG. 2A, the ribs 114 may extend generally axially with respect to the cylinder liner 100, with each rib 114 generally abutting or engaging the cylinder bore surface 202 (not shown in FIGS. 2A, 3A, 3B) when the liner 100 is placed within the engine bore 202. The ribs 114 generally increase the stiffness of the cylinder liner 100, at least about the secondary cooling gallery 106 area of the liner 100, by providing axial support to the liner 100, especially in the area of the secondary cooling gallery 106. Accordingly, the liner 100 not only provides increased cooling capacity resulting from the enlarged secondary cooling gallery 106, but also provides increased stiffness and resistance to warping that may otherwise tends to occur in the uppermost portion of the cylinder liner 100.

In addition to the axial undulation, i.e., up and down axially with respect to the cylinder liner 100, the secondary cooling gallery 106 may also undulate radially with respect to the outer surface(s) of the cylinder liner 100 as it extends about the periphery of the cylinder liner 100. For example, as best seen in FIGS. 3A, 3B, the cut surfaces 116 that define the cutouts 110, 112 define a varying radial depth with respect to the outer surfaces of the cylinder liner 100, e.g., the ribs 114. Radial undulation of the secondary cooling gallery 106 further increases the distance that the secondary cooling gallery 106 extends about the perimeter of the cylinder liner 100, further increasing cooling capacity of the cylinder liner 100.

The upper and lower rows of cutouts 110, 112 may each have a same number of cuts and overlap each other axially and circumferentially in order to provide the resulting waving or undulating secondary cooling gallery 106. More specifically, as best seen in FIG. 2B and described above, the upper and lower rows overlap axially by an overlap height $H_{OL}$. Additionally, as best seen in FIG. 3B, the cutouts 110 in the upper row generally overlap the cutouts 112 in the lower row peripherally or circumferentially around the liner 100. The circumferential offset may be a maximum of at least approximately half of an angular extent or period cutouts 110, 112. Thus, as seen in FIG. 3B, the angular offset between the ribs 114 is generally equal to one half of the angular extent of each cutout 110, 112. For example, the angular extent of the cutouts 110 in the upper row is an angle $C_C$. As there are twelve cutouts 110, 112 provided in each of the upper and lower rows in the illustrative example, the angle $C_C$ is approximately 30 degrees. The angular distance $C_{OS}$ between a rib 114 of the upper row to the next adjacent rib 114 in the lower row is approximately half the angular extent $C_C$ of the cutouts 110, 112. Generally, a larger circumferential overlap of the cutouts 110, 112 may result in higher coolant flow, up to the maximum overlap of half of the period/angular extent of the cutouts 110, 112. The resulting overlap pattern of generally uniform cutouts thus forms a waving or undulating cooling gallery 106 that extends generally about an entire perimeter of the cylinder liner 100.

While the cylinder liner 100 has been illustrated above having generally two rows of overlapping cutouts 110, 112, a larger number of rows may alternatively be employed. For example, three rows of cuts may be provided to form a similarly undulating secondary cooling gallery 106 about the periphery of the cylinder liner 100. A greater number of rows of cutouts 110, 112 may be desired where the upper flange 108 is sufficiently wide to allow for the greater material removal that may result where more than two rows of cutouts 110, 112 are employed. Further, a greater number of rows of cutouts may further increase cooling advantages of the exemplary cylinder liner 100. Moreover, there may be fewer or a greater number of cutouts for each row. In some approaches there may be a different number of cutouts for each row or the cutouts for each row may have a different depth. Thus, coolant flow may be adjusted for a particular application while maximizing cylinder liner strength and longevity using an appropriate combination of rows, cutouts per row, and even cutout depth. Finally, additional customization may be desirable by changing the longitudinal extent of a row of cutouts.

Figure 4:
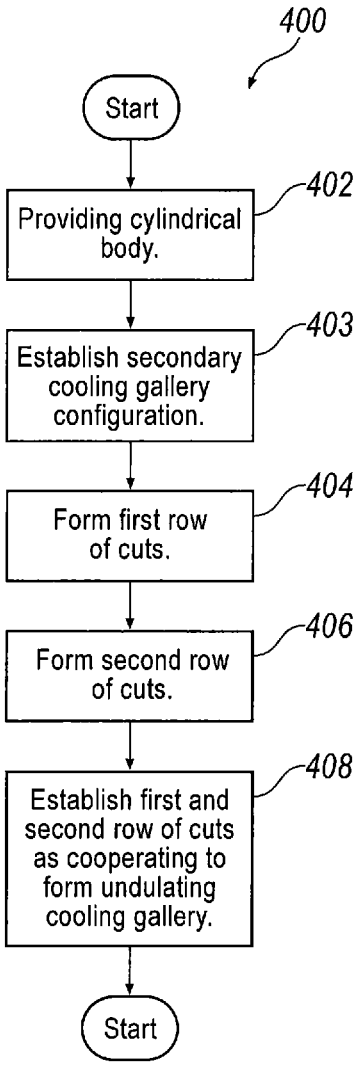
FIG. 4 is a process flow diagram of an exemplary method of making a cylinder liner.

Turning now to FIG. 4, an exemplary process 400 of making a cylinder liner is described. Process 400 may being at block 402, where a cylindrical body having an upper flange is provided. For example, as described above a main cylindrical body 102 and upper flange 108 may be provided in a cylinder liner 100. Process 400 may then proceed to block 403.

In block 403, a secondary cooling gallery configuration is established. For example, as described above, in one exemplary illustration a secondary cooling gallery 106 may be defined using a plurality of generally uniform cutouts 110, 112. As also described above, the cutouts 110, 112 may be provided in two rows 120, 122, where each row includes a same number of cutouts 110, 112. The cutouts 110, 112 may each define a generally same or uniform shape or configuration. Alternatively, there may be fewer or a greater number of cutouts for each row. The cutouts 110, 112 may also have a different depth. Thus, coolant flow may be adjusted for a particular application while maximizing cylinder liner strength and longevity using an appropriate combination of rows, cutouts per row, cutout depth, axial or longitudinal extent of one or more of the rows, etc.

Proceeding to block 404, a first row of cutouts may be formed about a periphery of the cylindrical body 102, where the periphery is generally adjacent the upper flange 108. For example, an upper row 120 of cutouts 110 may be formed in the main body 102 of a cylinder liner. Process 400 may then proceed to block 406.

At block 406, a second row of cutouts is formed about the periphery or circumference of the cylindrical body 102. Further, each cutout 110, 112 in the first and second rows 120, 122 generally have a same radial depth and a generally same peripheral extent with respect to the cylindrical body 102.

In forming the second row of cutouts 112, the first and second rows of cutouts 110, 112 may generally overlap each other in an axial direction with respect to the cylindrical body 102. Further, as described above each of the cutouts 110 of the first row may overlap the adjacent or associated cutouts 112 of the second row circumferentially, and vice versa. The cutouts 110, 112 of the first and second rows 120, 122 may also be formed with a material removal tool, e.g., a disc-shaped grinding tool 300, that defines a material removal surface corresponding to a radius of each of the cutouts 110, 112. In other words, the disc-shaped grinding tool 300 may form generally circular surfaces 116 that define a radius that is approximately equal to a radius of the disc-shaped grinding tool 300 itself. Process 400 may then proceed to block 408.

In block 408, the first and second rows of cutouts are established as cooperating to form a generally undulating cooling gallery defining a single flow path about the periphery of the cylindrical body when the cylindrical body is received within a mating engine bore. For example, a series of cutouts 112 may be formed in a lower row with respect to an initially formed upper row of cutouts 110. The cutouts 110, 112 may generally overlap circumferentially and axially to form a secondary cooling gallery 106 that undulates about the periphery of the cylinder liner 100.

With regard to the processes, systems, methods, heuristics, etc. described herein, it should be understood that, although the steps of such processes, etc. have been described as occurring according to a certain ordered sequence, such processes could be practiced with the described steps performed in an order other than the order described herein. It further should be understood that certain steps could be performed simultaneously, that other steps could be added, or that certain steps described herein could be omitted. In other words, the descriptions of processes herein are provided for the purpose of illustrating certain embodiments, and should in no way be construed so as to limit the claimed invention.

Accordingly, it is to be understood that the above description is intended to be illustrative and not restrictive. Many embodiments and applications other than the examples provided would be upon reading the above description. The scope of the invention should be determined, not with reference to the above description, but should instead be determined with reference to the appended claims, along with the full scope of equivalents to which such claims are entitled. It is anticipated and intended that future developments will occur in the arts discussed herein, and that the disclosed systems and methods will be incorporated into such future embodiments. In sum, it should be understood that the invention is capable of modification and variation and is limited only by the following claims.

All terms used in the claims are intended to be given their broadest reasonable constructions and their ordinary meanings as understood by those skilled in the art unless an explicit indication to the contrary in made herein. In particular, use of the singular articles such as "a," "the," "said," etc. should be read to recite one or more of the indicated elements unless a claim recites an explicit limitation to the contrary.

What is claimed is:

1. A cylinder liner for an internal combustion engine, comprising:

a cylindrical body configured to receive a piston assembly, the cylindrical body including a main body portion configured for selective engagement with an engine bore; and an upper flange configured to support the cylindrical body within the engine bore;

wherein the cylindrical body defines an undulating cooling gallery adjacent the upper flange, the undulating cooling gallery defining a coolant flow path extending about at least a portion of a perimeter of the cylindrical body;

wherein the coolant flow path is defined in part by a radially inner surface of the cooling gallery delimiting the coolant flow path between an axially upper surface and an axially lower surface such that coolant is forced to flow between the axially upper and lower surfaces about the portion of the perimeter of the cylindrical body; and wherein at least one of the axially upper and lower surfaces traverses axially in a first direction, axially in a second direction opposite the first direction, and axially in the first direction again with respect to the cylindrical body about the portion of the perimeter of the cylindrical body.

2. The cylinder liner of claim 1, wherein the coolant flow path undulates axially with respect to the main body portion.

3. The cylinder liner of claim 1, wherein the coolant flow path undulates radially with respect to the main body portion.

4. The cylinder liner of claim 1, wherein the undulating cooling gallery includes a series of cutouts about the perimeter.

5. The cylinder liner of claim 4, wherein the undulating cooling gallery includes at least an upper row of cutouts and a lower row of cutouts.

6. The cylinder liner of claim 5, wherein the upper and lower rows overlap in an axial direction with respect to the cylinder liner.

7. The cylinder liner of claim 6, wherein the upper and lower rows overlap in an axial direction of the cylinder liner about at least a portion of the perimeter of the cylinder liner.

8. The cylinder liner of claim 5, wherein each of the cutouts of the upper row are offset peripherally about the cylindrical body with respect to a respective cutout in the lower row.

9. The cylinder liner of claim 8, wherein each of the cutouts of the upper row define a circumferential extension about the perimeter of the cylindrical body, and the respective cutouts in the lower row are offset peripherally from the cutouts of the upper row by approximately a maximum of half of the circumferential extension.

10. The cylinder liner of claim 4, wherein the undulating cooling gallery includes an axial rib between each of the cutouts.

11. The cylinder liner of claim 4, wherein the cutouts each define a semicircular surface.

12. The cylinder liner of claim 4, wherein the cutouts each define a varying radial depth with respect to an outer surface of the cylindrical body.

13. The cylinder liner of claim 4, wherein the main body includes a primary cooling gallery configured to receive a coolant flow separate from the undulating cooling gallery.

14. The cylinder liner of claim 4, wherein said cutouts are generally uniformly shaped.

15. The cylinder liner of claim 4, wherein said cutouts are positioned in at least two rows offset from each other axially with respect to an axis of the cylinder liner.

16. The cylinder liner of claim 15, wherein said at least two rows each have a same number of cutouts.

17. The cylinder liner of claim 1, wherein the undulating cooling gallery defines a single coolant flow path about the portion of the perimeter of the cylindrical body.

18. A cylinder liner for an internal combustion engine, comprising:

a cylindrical body configured to receive a piston assembly, the cylindrical body including a main body portion configured for selective engagement with an engine bore; and an upper flange configured to support the cylindrical body within the engine bore;

wherein the cylindrical body defines an undulating cooling gallery adjacent the upper flange, the undulating cooling gallery defining a coolant flow path extending about at least a portion of a perimeter of the cylindrical body; wherein the undulating cooling gallery includes a series of cutouts about the perimeter such that the cooling gallery defines in part the coolant flow path, the coolant flow path undulating axially and radially with respect to the main body portion;

wherein the undulating cooling gallery includes at least an upper row of cutouts and a lower row of cutouts, wherein the upper and lower rows overlap in an axial direction with respect to the cylinder liner, wherein each of the cutouts of the upper row are offset peripherally about the cylindrical body with respect to a respective cutout in the lower row.

19. The cylinder liner of claim 18, wherein each of the cutouts of the upper row define a circumferential extension about the perimeter of the cylindrical body, and the respective cutouts in the lower row are offset peripherally from the cutouts of the upper row by approximately a maximum of half of the circumferential extension.

20. The cylinder liner of claim 18, wherein the cutouts each define a varying radial depth with respect to an outer surface of the cylindrical body.

21. The cylinder liner of claim 18, wherein the undulating cooling gallery defines a single coolant flow path about the portion of the perimeter of the cylindrical body.

22. A cylinder liner for an internal combustion engine, comprising:

a cylindrical body configured to receive a piston assembly, the cylindrical body including a main body portion configured for selective engagement with an engine bore; and an upper flange configured to support the cylindrical body within the engine bore;

wherein the cylindrical body defines an undulating cooling gallery adjacent the upper flange, the undulating cooling gallery defining a coolant flow path extending about at least a portion of a perimeter of the cylindrical body; and wherein the coolant flow path undulates radially with respect to the main body portion.

23. The cylinder liner of claim 22, wherein the undulating cooling gallery defines a single coolant flow path about the portion of the perimeter of the cylindrical body.

24. The cylinder liner of claim 22, wherein the undulating cooling gallery includes a series of cutouts about the perimeter.

* * * * *